US007602236B2

(12) United States Patent
Jo

(10) Patent No.: US 7,602,236 B2
(45) Date of Patent: Oct. 13, 2009

(54) BAND GAP REFERENCE VOLTAGE GENERATION CIRCUIT

(75) Inventor: Eun Sang Jo, Bucheon-si (KR)

(73) Assignee: Dongbu Electronics Co., Ltd., Seoul (KR)

( * ) Notice: Subject to any disclaimer, the term of this patent is extended or adjusted under 35 U.S.C. 154(b) by 341 days.

(21) Appl. No.: 11/645,530

(22) Filed: Dec. 27, 2006

(65) Prior Publication Data

US 2007/0146059 A1 Jun. 28, 2007

(30) Foreign Application Priority Data

Dec. 28, 2005 (KR) ..... 10-2005-0132609

(51) Int. Cl.
*G05F 3/02* (2006.01)

(52) U.S. Cl. ..... 327/539; 327/541

(58) Field of Classification Search ..... 327/538–541
See application file for complete search history.

(56) References Cited

U.S. PATENT DOCUMENTS 5,818,292 A * 10/1998 Slemmer ..... 327/539
5,900,773 A * 5/1999 Susak ..... 327/539
6,121,813 A * 9/2000 Furuchi ..... 327/285
6,707,343 B2 * 3/2004 Franca-Neto ..... 331/18
6,774,711 B2 * 8/2004 Bernard ..... 327/539
7,148,672 B1 * 12/2006 Holmes ..... 323/316
7,199,646 B1 * 4/2007 Zupcau et al. ..... 327/539
7,397,279 B2 * 7/2008 Bhattacharya et al. ..... 326/80

* cited by examiner

*Primary Examiner*—Lincoln Donovan
*Assistant Examiner*—Hai L Nguyen
(74) *Attorney, Agent, or Firm*—Finnegan, Henderson, Farabow, Garrett & Dunner, L.L.P.

(57) ABSTRACT

There is provided a band gap reference voltage generation circuit capable of reducing wake up time during transition from an idle mode to a normal mode and further capable of removing the RF noise of an output voltage. The band gap reference voltage generation circuit includes an operation amplifier for outputting a uniform voltage in accordance with a reference voltage input to an inversion terminal and a non-inversion terminal; a first-type first transistor for outputting a power source voltage in accordance a power down signal; a first-type second transistor for outputting bias current corresponding to an output voltage from the operation amplifier using an output voltage from the first-type first transistor; a reference voltage circuit for supplying a reference voltage to the inversion terminal and the non-inversion terminal using the bias current; a second-type first transistor different from the first-type first transistor for supplying a base voltage to the output port of the operation amplifier in accordance with the power down signal; a start up circuit for driving the entire circuit during power up; a first node between the second-type second transistor and the reference voltage circuit; and an output terminal connected to the first node.

5 Claims, 4 Drawing Sheets

BAND GAP REFERENCE VOLTAGE GENERATION CIRCUIT

RELATED APPLICATION

This application claims the benefit of Korean Application No. 10-2005-0132609, filed on Dec. 28, 2005, which is incorporated by reference herein in its entirety.

BACKGROUND

1. Technical Field

The present invention relates to a band gap reference voltage generation circuit. More specifically, the present invention relates to a band gap reference voltage generation circuit capable of reducing wake up time during the transition from an idle mode to a normal mode and further capable of removing radio frequency (RF) noise of an output voltage.

2. Description of the Related Art

In a semiconductor integrated circuit, stability of an internal operation voltage is very important to secure the reliability of a semiconductor device. That is, even if an external power source voltage changes, such a change must not exert influence upon the integrated circuit. The devices must perform their unique functions in a stable manner. To this end, a band gap reference voltage generation circuit that always supplies a uniform voltage is necessary.

Recently, in semiconductor integrated circuits, since low voltage supply source circuits have been essentially adopted, a reference voltage generation circuit is necessary. However, the band gap reference voltage generation circuit has unstable factors mainly caused by changes in the temperature or process conditions.

The band gap reference voltage generation circuit generates a uniform range of electric potential in spite of a change in the temperature.

FIG. 1 is a circuit diagram illustrating a conventional band gap reference voltage generating circuit.

Referring to FIG. 1, the conventional band gap reference voltage generation circuit may include several components. First, it may include an operation amplifier 10 for outputting a uniform voltage in accordance with a reference voltage input to an inversion terminal (−) and a non-inversion terminal (+). Second, it may include first PMOS transistor PM1 for outputting a bias current corresponding to an output voltage from the operation amplifier 10 using a power source voltage VDD. Third, it may include reference voltage circuit 20 for supplying the reference voltage to the inversion terminal (−) and the non-inversion terminal (+) of the operation amplifier 10 using bias current. Fourth, it may include a start up circuit 30 for driving the entire circuit during power up. Finally, it may include output terminal NO positioned between first PMOS transistor PM1 and reference voltage circuit 20.

First PMOS transistor PM1 is switched in accordance with the output voltage of operation amplifier 10 and includes a source terminal connected to power source voltage VDD and a drain terminal connected to output terminal NO. First PMOS transistor PM1 supplies the bias current corresponding to the output voltage of operation amplifier 10 to reference voltage circuit 20.

Reference voltage circuit 20 may also include several components including a first resistor R1 and a first bipolar transistor Q1 serially connected between output terminal NO and a base voltage VSS. It may also include second and third resistors R2 and R3 and a second bipolar transistor Q2 serially connected between output terminal NO and base voltage VSS.

A first node N1 between first resistor R1 and first bipolar transistor Q1 is connected to inversion terminal (−) of operation amplifier 10.

A node N2 between second resistor R2 and third resistor R3 is connected to non-inversion terminal (+) of operation amplifier 10.

The base terminals of first and second bipolar transistors Q1 and Q2 are connected to base voltage VSS to be current mirrors.

The emitter terminal of first bipolar transistor Q1 is connected to first node N1 and the collector terminal of first bipolar transistor Q1 is connected to base voltage VSS.

The emitter terminal of second bipolar transistor Q2 is connected to third resistor R3 and the collector terminal of second bipolar transistor Q2 is connected to base voltage VSS.

Reference voltage circuit 20 flows uniform current to base voltage source VSS through first and second bipolar transistors Q1 and Q2, which are connected in the current mirrors by the resistivity of first to third resistors R1, R2, and R3. This provides positive and negative reference voltages to inversion terminal (−) and non-inversion terminal (+) of operation amplifier 10.

Operation amplifier 10 outputs a uniform band voltage Vband in accordance with the reference voltage supplied from first and second nodes N1 and N2 of reference voltage circuit 20.

A second PMOS transistor PM2 is connected to power source voltage VDD in the form of a diode to supply power source voltage VDD to first PMOS transistor PM1.

A start up circuit 30 may include several components. First, it may include a third PMOS transistor PM3 controlled in accordance with a power down signal pwd and connected to power source voltage VDD. Second, start up circuit 30 may include a fourth PMOS transistor PM4 whose gate terminal is connected to the source terminal, which is connected to the drain terminal of third PMOS transistor PM3. Third, start up circuit 30 may include first to third NMOS transistors NM1 to NM3 serially connected to fourth PMOS transistor PM4 in the form of diodes. Fourth, start up circuit 30 may include a fifth PMOS transistor PM5 for outputting the output voltage of operation amplifier 10 in accordance with the gate voltage of first to third NMOS transistors NM1 to NM3. Finally, start up circuit 30 may include a fourth NMOS transistor NM4 controlled in accordance with inversed power down signal pwdb and connected to fifth PMOS transistor PM5 and connected to base voltage VSS.

Start up circuit 30 wakes up operation amplifier 10 during a transition from an idle mode to a normal mode.

The conventional reference voltage generation circuit adds the voltage generated by a proportional to the absolute temperature (PTAT) circuit and the voltage of a base-emitter junction having a negative temperature coefficient to each other to output a stable reference voltage that is not affected by a change in temperature.

Most analog & mixed mode IPs are designed with enough margin to be insensitive to temperature, power source voltage, and a change in manufacturing process. However, when a change in the manufacturing process exceeds process mismatch statistical data provided by a foundry industry, production yield is significantly affected.

FIG. 2 is a simulation graph for the band gap outputs of the conventional band gap reference voltage generation circuit.

As illustrated in FIG. 2, the conventional reference voltage generation circuit outputs a stable reference voltage when the two input transistors in operation amplifier 10 are realized in a process having mismatch A of 0%. However, since the conventional reference voltage generation circuit outputs a reference voltage of about 0.4V when the two input transistors in operation amplifier 10 are realized in a process having mismatch B no less than 0.11%, the conventional reference voltage generation circuit cannot be used as a reference voltage circuit.

To be specific, when start up circuit 30 is in the idle mode, the output of operation amplifier 10 is in a high state. During transition from the idle mode to the normal mode, mismatching in which the input port transistor in operation amplifier 10 is beyond an allowable range is generated due to a change in a process or, when start up circuit 30 does not normally operate, the output voltage of operation amplifier 10 in a band gap is not set or in a high state.

Therefore, in a conventional reference voltage generating circuit, during a transition from the idle mode to the normal mode, due to the low wake up time caused by start up circuit 30, operation amplifier 10 does not have a stable wake up point.

SUMMARY

The present invention has been made to solve the above problem occurring in the prior art, and therefore, consistent with the present invention, there is provided a band gap reference voltage generation circuit capable of reducing wake up time during transition from an idle mode to a normal mode and further capable of removing output voltage RF noise.

Consistent with the present invention, there is provided a band gap reference voltage generation circuit, including an operation amplifier for outputting a uniform voltage in accordance with a reference voltage input to an inversion terminal and a non-inversion terminal; a first-type first transistor for outputting a power source voltage in accordance with a power down signal; a first-type second transistor for outputting bias current corresponding to an output voltage from the operation amplifier using an output voltage from the first-type first transistor; a reference voltage circuit for supplying a reference voltage to the inversion terminal and the non-inversion terminal using the bias current; a second-type first transistor different from the first-type first transistor for supplying a base voltage to the output port of the operation amplifier in accordance with the power down signal; a start up circuit for driving the entire circuit during power up; a first node between the second-type second transistor and the reference voltage circuit; and an output terminal connected to the first node.

The band gap reference voltage generation circuit may further include a noise filter circuit connected to the power source voltage, the base voltage, and the first node to remove the RF noise of the output voltage of the first node and to output the output voltage to the output terminal.

The reference voltage circuit may include a first resistor and a first bipolar transistor serially connected to the first node and the base voltage and second and third resistors and a second bipolar transistor serially connected to the first node and the base voltage.

The first and second bipolar transistors form current mirrors.

The start up circuit may include a first-type third transistor controlled in accordance with the power down signal and connected to the power source voltage; a first-type fourth transistor whose gate terminal is connected to the source terminal connected to the drain terminal of the first-type third transistor and to the drain terminal thereof; second-type second to fourth transistors serially connected to the first-type fourth transistor in the form of diodes; a first-type fifth transistor for outputting the output voltage of the operation amplifier in accordance with the gate voltage of the second-type second to fourth transistors; and a second-type fifth transistor controlled in accordance with an inversed power down signal and connected to the first-type fifth transistor and the base voltage.

The noise filter circuit may include a first-type sixth transistor connected between the first node and the output terminal, a first-type seventh transistor connected between the power source voltage and the output terminal, and a second-type sixth transistor controlled in accordance with the power down signal and connected between the output terminal and the base voltage, wherein the first type is p-type, and the second type is n-type.

DETAILED DESCRIPTION

A reference voltage generating circuit consistent with the present invention will be described with reference to the attached drawing.

Figure 1:
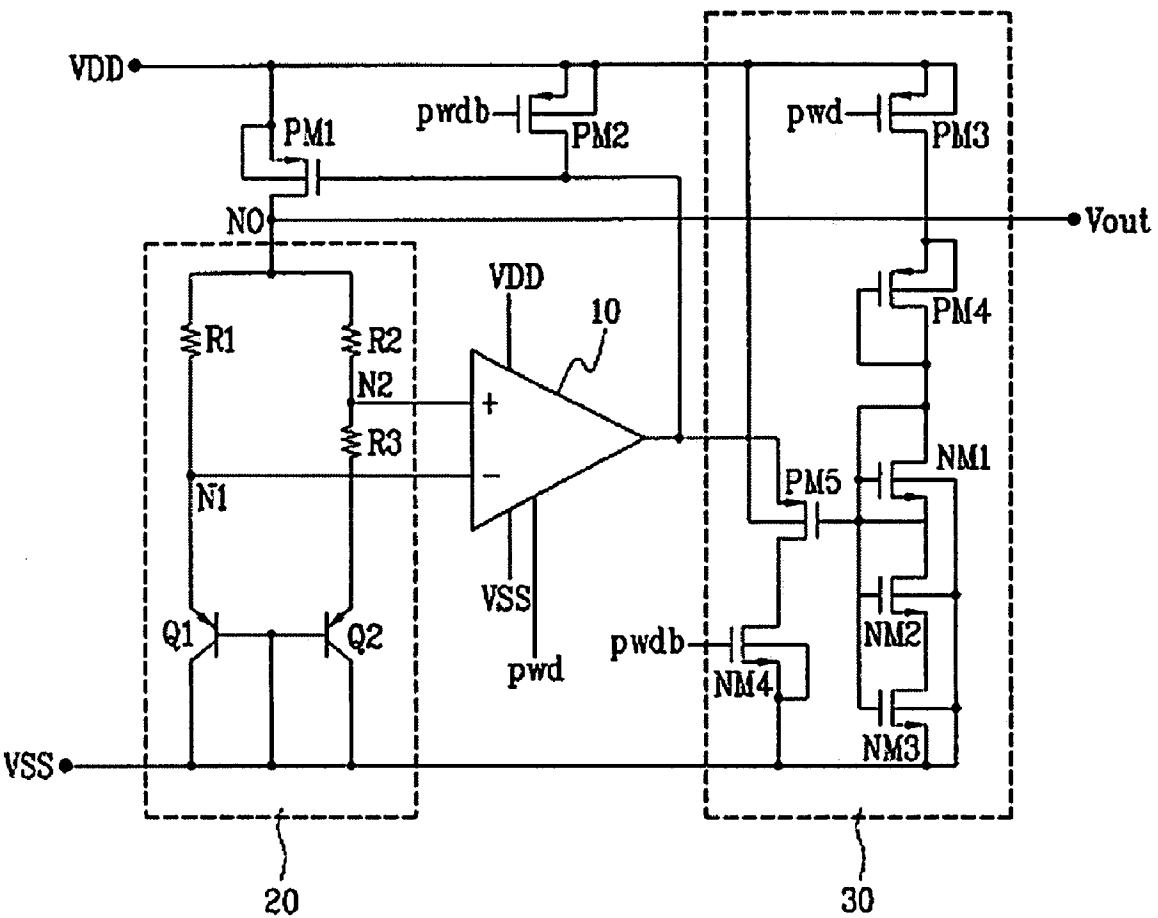
FIG. 1 PRIOR ART
FIG. 1 is a circuit illustrating a conventional band gap reference voltage generation circuit.
Figure 2:
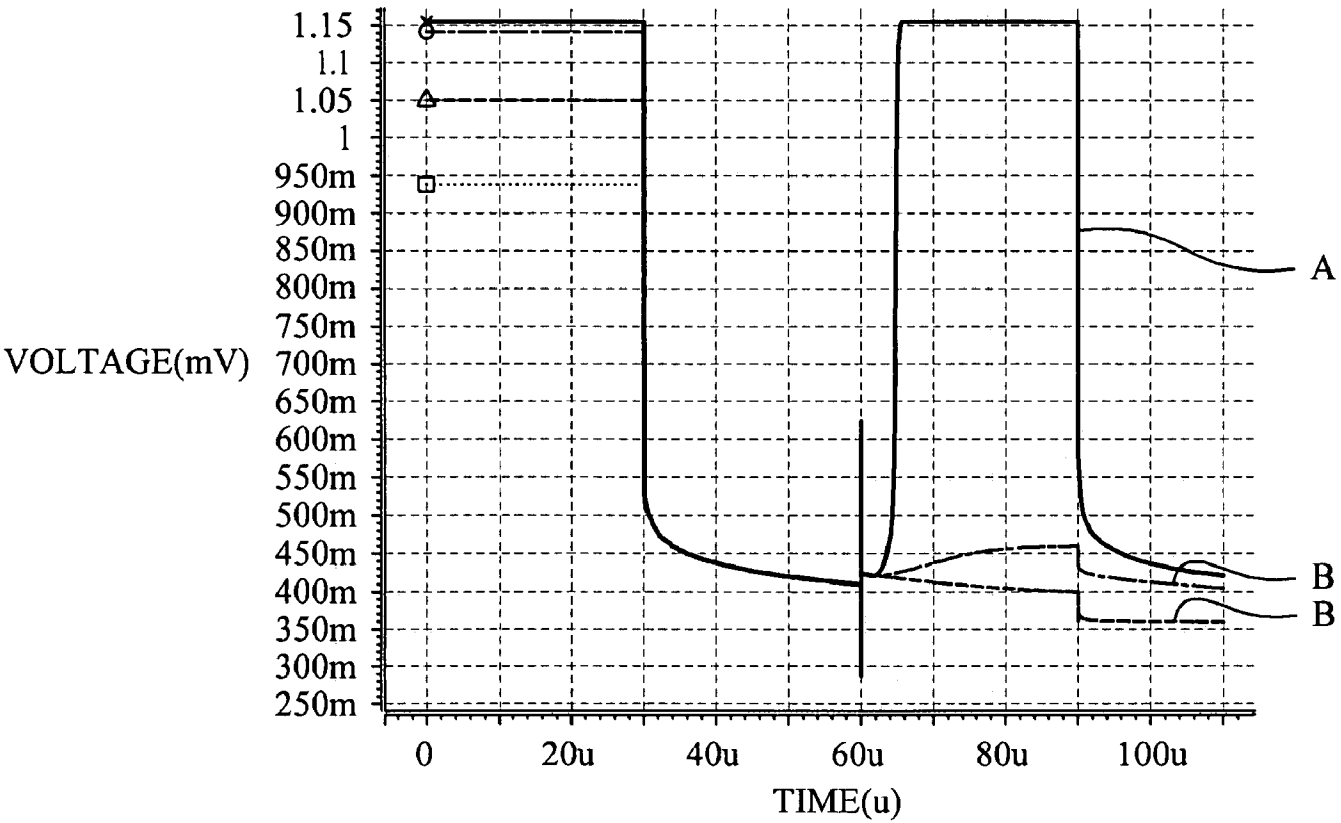
FIG. 2 PRIOR ART
FIG. 2 is a simulation graph for the band gap outputs of the conventional band gap reference voltage generation circuit.
Figure 3:
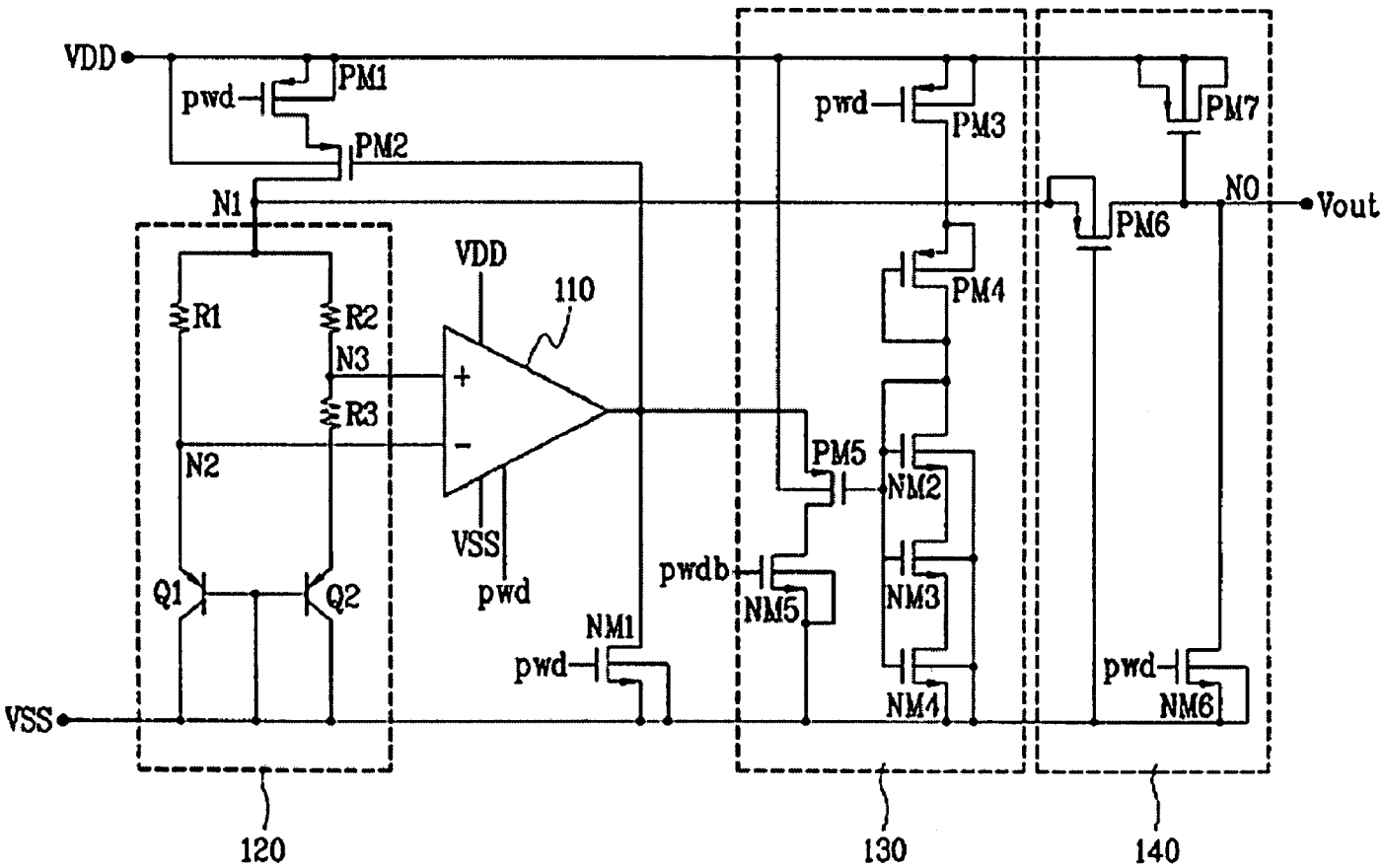
FIG. 3 is a circuit illustrating a band gap reference voltage generation circuit consistent with the present invention.

FIG. 3 is a circuit illustrating a band gap reference voltage generation circuit consistent with the present invention.

Referring to FIG. 3, a reference voltage generation circuit according to an embodiment of the present invention includes an operation amplifier 110 for outputting a uniform voltage in accordance with a reference voltage input to an inversion terminal (−) and a non-inversion terminal (+); a first PMOS transistor PM1 for outputting a power source voltage VDD in accordance with a power down signal pwd; a second PMOS transistor PM2 for outputting bias current corresponding to the output voltage from operation amplifier 110 using the output voltage from first PMOS transistor PM1; a reference voltage circuit 120 for supplying the reference voltage to inversion terminal (−) and non-inversion terminal (+) of operation amplifier 110 using the bias current; a first NMOS transistor NM1 for supplying a base voltage VSS to the output port of operation amplifier 110 in accordance with power down signal pwd; a start up circuit 130 for driving the entire circuit during power up; a first node N1 positioned between second PMOS transistor PM2 and reference voltage circuit 120; a noise filter circuit 140 connected to power source voltage VDD; base voltage VSS; and first node N1 to remove the RF noise of the output voltage and to output the output voltage to an output terminal NO.

First PMOS transistor PM1 includes a gate terminal to which power down signal pwd is supplied, a source terminal connected to power source voltage VDD, and a drain terminal connected to the source terminal of second PMOS transistor PM2. First PMOS transistor is turned on in accordance with power down signal pwd being in a high state to supply power source voltage VDD to second PMOS transistor PM2.

Second PMOS transistor PM2 includes a gate terminal to which the output voltage of operation amplifier 110 is supplied, a source terminal connected to drain terminal of first PMOS transistor PM2, and a drain terminal connected to first node N1. Second PMOS transistor supplies the bias current corresponding to the output voltage of operation amplifier 110 to reference voltage circuit 120 using power source voltage VDD supplied from first PMOS transistor PM1.

First NMOS transistor NM1 includes a gate terminal to which power down signal pwd is supplied, a drain terminal to which the output voltage of operation amplifier 110 is supplied, and a source terminal connected to base voltage VSS. First NMOS transistor NM1 is turned on in accordance with the power down signal pwd in the high state to discharge base voltage VSS as the output voltage of operation amplifier 110.

Reference voltage circuit 120 includes a first resistor R1 and a first bipolar transistor Q1 serially connected to first node N1 and base voltage VSS. Reference voltage circuit 120 also includes second and third resistors R2 and R3 and a second bipolar transistor Q2 serially connected to first node N1 and base voltage VSS.

A second node N2 between first resistor R1 and first bipolar transistor Q1 is connected to inversion terminal (−) of operation amplifier 10.

A third node N3 between second resistor R2 and third resistor R3 is connected to non-inversion terminal (+) of operation amplifier 10.

The base terminals of first and second bipolar transistors Q1 and Q2 are connected to base voltage VSS to be current mirrors.

The emitter terminal of first bipolar transistor Q1 is connected to second node N2 and the collector terminal of first bipolar transistor Q1 is connected to base voltage VSS.

The emitter terminal of second bipolar transistor Q2 is connected to third resistor R3 and the collector terminal of first bipolar transistor Q2 is connected to base voltage VSS.

Reference voltage circuit 120 supplies uniform current to base voltage source VSS through first and second bipolar transistors Q1 and Q2 connected in the current mirrors by the resistivity of first to third resistors R1, R2, and R3 to provide positive and negative reference voltages to inverse terminal (−) and non-inverse terminal (+) of operation amplifier 110.

Operation amplifier 110 outputs a uniform band voltage Vband in accordance with the reference voltage supplied from second and third nodes N2 and N3 of reference voltage circuit 120.

A start up circuit 130 includes a third PMOS transistor PM3 controlled in accordance with power down signal pwd and connected to power source voltage VDD; a fourth PMOS transistor PM4 whose gate terminal is connected to the source terminal connected to the drain terminal of third PMOS transistor PM3 and to the drain terminal thereof; second to fourth NMOS transistors NM2 to NM4 serially connected to fourth PMOS transistor PM4 in the form of diodes; a fifth PMOS transistor PM5 for outputting the output voltage of operation amplifier 110 in accordance with the gate voltage of second to fourth NMOS transistors NM2 to NM4; and a fifth NMOS transistor NM5 controlled in accordance with inversed power down signal pwdb and connected to fifth PMOS transistor PM5 and connected to base voltage VSS.

Start up circuit 130 wakes up operation amplifier 110 during the transition from an idle mode to a normal mode.

Noise filter circuit 140 includes a sixth PMOS transistor PM6 connected between first node N1 and output terminal NO, a seventh PMOS transistor PM7 connected between power source voltage VDD and output terminal NO, and a sixth NMOS transistor NM6 controlled in accordance with power down signal pwd and connected between output terminal NO and base voltage VSS.

A sixth PMOS transistor PM6 includes a gate terminal to which base voltage VSS is supplied, a source terminal connected to first node N1, and a drain terminal connected to output terminal NO. Sixth PMOS transistor PM6 may function as a capacitor.

A seventh PMOS transistor PM7 includes a gate terminal connected to the output terminal and source and drain terminals to which power source voltage VDD is supplied. Seventh PMOS transistor PM7 may function to provide an impedance.

Sixth NMOS transistor NM6 includes a gate terminal to which power down signal pwd is supplied, a source terminal to which base voltage VSS is supplied and a drain terminal connected to output terminal NO. Sixth NMOS transistor NM6 may function as a capacitor.

Noise filter circuit 140 removes the RF noise component of the band gap reference voltage output from first node N1 using sixth and seventh PMOS transistors PM6 and PM7.

Consistent with the present invention, in the idle mode, the output voltage of operation amplifier 110 is maintained to be in a low state using first NMOS transistor NM1 so that it is possible to improve the stability problem caused by the start up. Also, in the idle mode, second PMOS transistor PM2 that supplies the bias current to resistors R1, R2, and R3 and bipolar transistors Q1 and Q2 of reference voltage circuit 120 through first PMOS transistor PM1 is maintained to be always turned on.

Therefore, in the band gap reference voltage generation circuit consistent with the present invention, during transition from the idle mode to the normal mode, the operation amplifier 110 has the stable wake up time within a short time so that it is possible to improve the stability problem caused by the start up.

Also, in the band gap reference voltage generation circuit consistent with the present invention, the RF noise of the band gap reference voltage output through the noise filter circuit 140 is removed so that it is possible to generate a stable band gap reference voltage.

Figure 4:
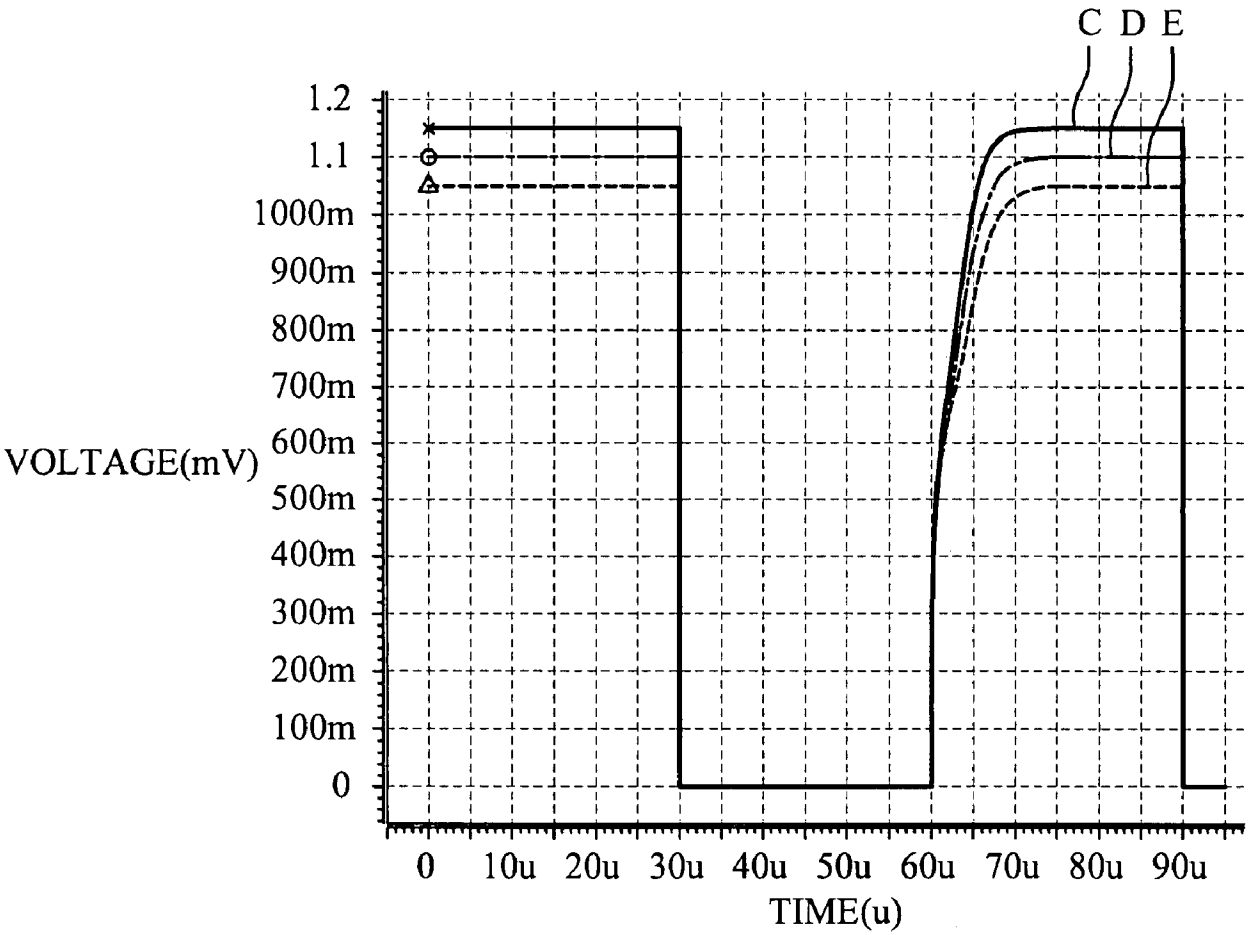
FIG. 4 is a simulation graph for the band gap outputs of the band gap reference voltage generation circuit consistent with the present invention.

FIG. 4 is a simulation graph for the band gap outputs of the band gap reference voltage generation circuit according to the embodiment of the present invention.

As illustrated in FIG. 4, according to the present invention, although the two input transistors in operation amplifier 110 are mismatched by about 0.5 to 1%, it is possible to output a stable band gap reference voltages D and E.

On the other hand, in FIG. 4, a graph C illustrates the band gap output in a state where the two input transistors in operation amplifier 110 are matched.

While the invention has been shown and described with reference to certain preferred embodiments thereof, it will be understood by those skilled in the art that various changes in form and details may be made therein without departing from the spirit and scope of the invention as defined by the appended claims.

The above-described band gap reference voltage generating circuit has the following effects.

First, the wake up time of the band gap reference voltage generation circuit in accordance with the start up is reduced so that it is possible to improve the stability.

Second, although the two input transistors in the operation amplifier are mismatched by about 1%, it is possible to output a stable band gap reference voltage and to improve the stability of the band gap output.

What is claimed is:

1. A band gap reference voltage generation circuit comprising:

an operation amplifier for outputting a uniform voltage in accordance with a reference voltage input to an inversion terminal and a non-inversion terminal;

a first-type first transistor for outputting a power source voltage in accordance with a power down signal;

a first-type second transistor for outputting a bias current corresponding to the uniform voltage in response to the power source voltage from the first-type first transistor;

a reference voltage circuit for supplying a reference voltage to the inversion terminal and the non-inversion terminal in response to the bias current;

a second-type first transistor for supplying a base voltage to an output port of the operation amplifier in accordance with the power down signal;

a start up circuit for driving the bandgap reference circuit during power up;

a first node between the first-type second transistor and the reference voltage circuit;

an output terminal connected to the first node; and a noise filter circuit connected to the power source voltage, the base voltage, and the first node to remove RF noise of an output voltage of the first node and to output the output voltage of the first node to the output terminal, wherein the noise filter circuit comprises:

a first-type sixth transistor connected between the first node and the output terminal;

a first-type seventh transistor connected between the power source voltage and the output terminal; and a second-type sixth transistor controlled in accordance with the power down signal and connected between the output terminal and the base voltage; wherein the first-type sixth transistor functions as a capacitor and includes a gate terminal connected to the base voltage, a source terminal connected to the first node, and a drain terminal connected to the output terminal, and the first-type seventh transistor functions to provide an impedance and includes a gate terminal connected to the output terminal and source and drain terminals connected to the power source voltage.

2. The band gap reference voltage generation circuit of claim 1, wherein first-type transistors are p-type, and second-type transistors are n-type.

3. The band gap reference voltage generation circuit of claim 1, wherein the reference voltage circuit comprises:

a first resistor and a first bipolar transistor serially connected to the first node and the base voltage; and second and third resistors and a second bipolar transistor serially connected to the first node and the base voltage.

4. The band gap reference voltage generation circuit of claim 3, wherein the first and second bipolar transistors form current mirrors.

5. The band gap reference voltage generation circuit of claim 1, wherein the start up circuit comprises:

a first-type third transistor controlled in accordance with the power down signal and connected to the power source voltage;

a first-type fourth transistor whose gate terminal is connected to a drain and a source terminal of the first-type fourth transistor, which is connected to a drain terminal of the first-type third transistor;

second-type second to fourth transistors serially connected to the first-type fourth transistor in the form of diodes;

a first-type fifth transistor for outputting the output voltage of the operation amplifier in accordance with the gate voltage of the second-type second to fourth transistors; and a second-type fifth transistor controlled in accordance with an inversed power down signal and connected to the first-type fifth transistor and the base voltage.

* * * * *